US005116105A

United States Patent [19]

Hong

[11] Patent Number: 5,116,105

[45] Date of Patent: May 26, 1992

[54] DRINK CONTAINER WITH PIPETTE

[76] Inventor: Pi-Lien Hong, 1F, No. 13, Alley 158, Lane 30, Yung-Chi Rd., Taipei, Taiwan

[21] Appl. No.: 620,616

[22] Filed: Dec. 3, 1990

[51] Int. Cl.[5] ..... B65D 77/28

[52] U.S. Cl. ..... 229/103.1; 220/2; 220/708; 220/710

[58] Field of Search ..... 229/103.1; 215/1 A, 215/229; 220/90.2, 90.4, 90.6, DIG. 7

[56] References Cited

U.S. PATENT DOCUMENTS 2,849,321 8/1958 Lhermitte et al. ..... 229/103.1
3,074,612 1/1963 Schneider .

FOREIGN PATENT DOCUMENTS 0305789 3/1989 European Pat. Off. ..... 229/103.1
2452440 11/1980 France ..... 229/103.1

*Primary Examiner*—Stephen Marcus
*Assistant Examiner*—Christopher J. McDonald
*Attorney, Agent, or Firm*—Darjen Int'l Patent and Trademark Office

[57] ABSTRACT

Paper container device consists of a cuboid container body with a round hole made of aluminium foil paper and a sucking pipette having an extending portion with a sharp end. The round hole is disposed at the uppermost middle portion of the right side of the container body. The upper right folded triangle portion on the upper side is folded down and glued to the surface of the right side. the pipette is partly glued between the right folded triangle portion and the surface of the right side. The pipette together with the triangle portion can be torn apart and its sharp end can pierce through the aluminium foil into the container body for sucking out the drink in it.

2 Claims, 5 Drawing Sheets

DRINK CONTAINER WITH PIPETTE

BACKGROUND OF THE INVENTION

1. Field of the Invention

This invention relates to a container device, particularly to a paper container device which has a small hole closely covered with an aluminium foil for the easy putting in of a pipette for a drink.

2. Description of the Prior Art

In recent years, the paper container for a soft drink has become popular with the customers partly because it is easy to carry about and partily because it may sanitarily preserve a drink for at least six months. However, a sharp sucking pipette usually has to be attached to the traditional paper container having a small round hole sealed by an aluminium foil so that the users may easily put the pipette into the hole for a drink. It may become a great inconvenience for the users when the attached pipette is missing. Moreover, it becomes troublesome when the aluminium foil sealing the round hole of a traditional container is broken or damaged to permit leakage of the drink.

SUMMARY OF THE INVENTION

Paper container of the present invention consists of a container body and a sucking pipette. The container body is made of a rectangular piece of paper with a round hole at a proper place. The rectangular piece of paper with its round hole is water-tightly glued to a piece of aluminium foil. The piece of paper together with the glued aluminium foil is folded and glued to form a three dimentional container with six sides in enclosed state.

The round hole is made at a proper place so that it may appear at the uppermost middle portion of the right side of the container body when the rectangular piece of paper is folded into the container body.

The container body has four folded triangle portions. The upper right folded triangle portion on the upper side is glued to the right side so as to cover the sucking pipette and the round whole. The sucking pipette having an extending portion with a sharp end is enclosed by a small thin p.v.c. bag and is partly glued between the folded triangle portion and the surface of the right side. Under the protection of the folded triangle portion, the pipette will not drop off easily and the aluminium foil sealing the round hole will not be damaged or broken.

The upper right folded triangle portion with the pipette may be easily torn apart from the surface of the right side. The extending portion of the pipette can be pushed to have its sharp end pierce through the aluminium foil and into the round hole. After the piercing action of the pipette, the container body can be held horizontally to let the round hole be at the lowest position so as to easily suck the drink out of the container body completely.

DRAWING REFERENCE NUMERALS

Figure 1:
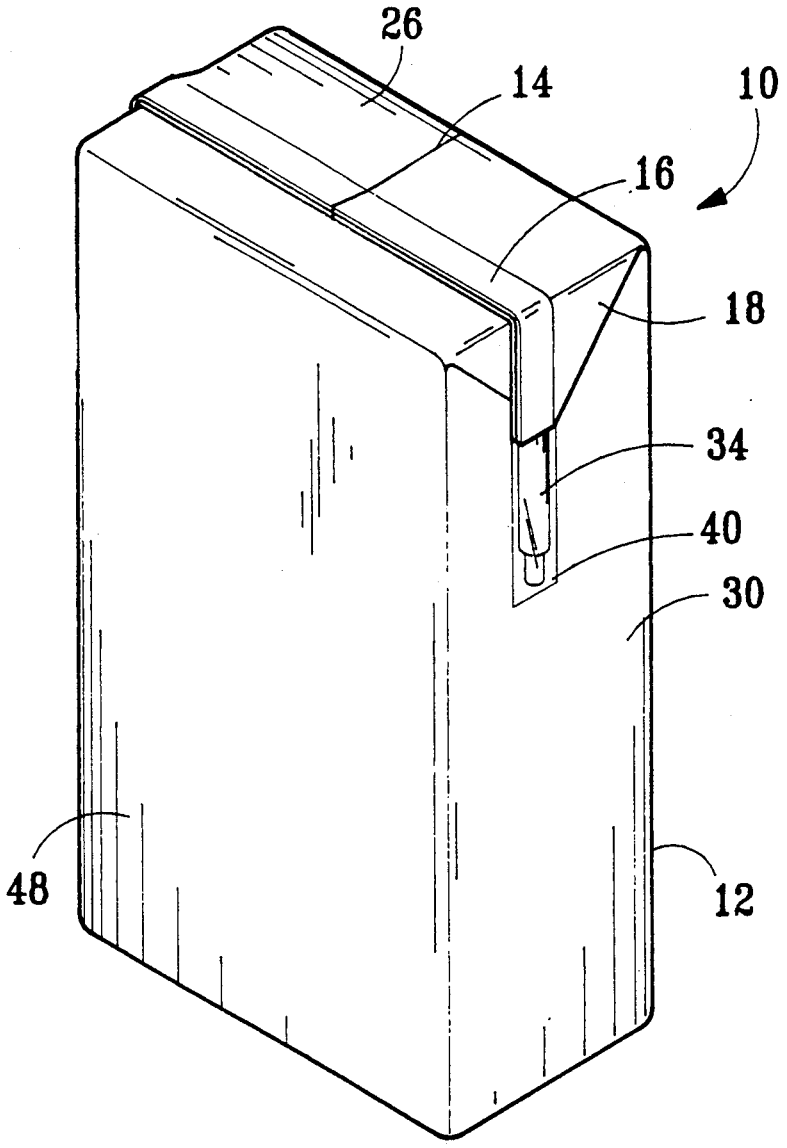
FIG. 1 is a perspective view of the paper container with a sucking pipette according to the invention.

10: container body
12: a piece of paper
14: glued edge portion
16: glued central flange of top side of 1
18, 20, 22, 24: folded triangle-portion
26: top side of 10
28, 30: left side and right side of 10
32: bottom side of 10
34: inner sucking pipette
40: small p.v.c. bag
42: round hole for the putting in of a pipette
46: membrance of aluminium foil
50: hollow outer pipette.

DETAILED DESCRIPTION OF THE PREFERRED EMBODIMENT

Figure 3:
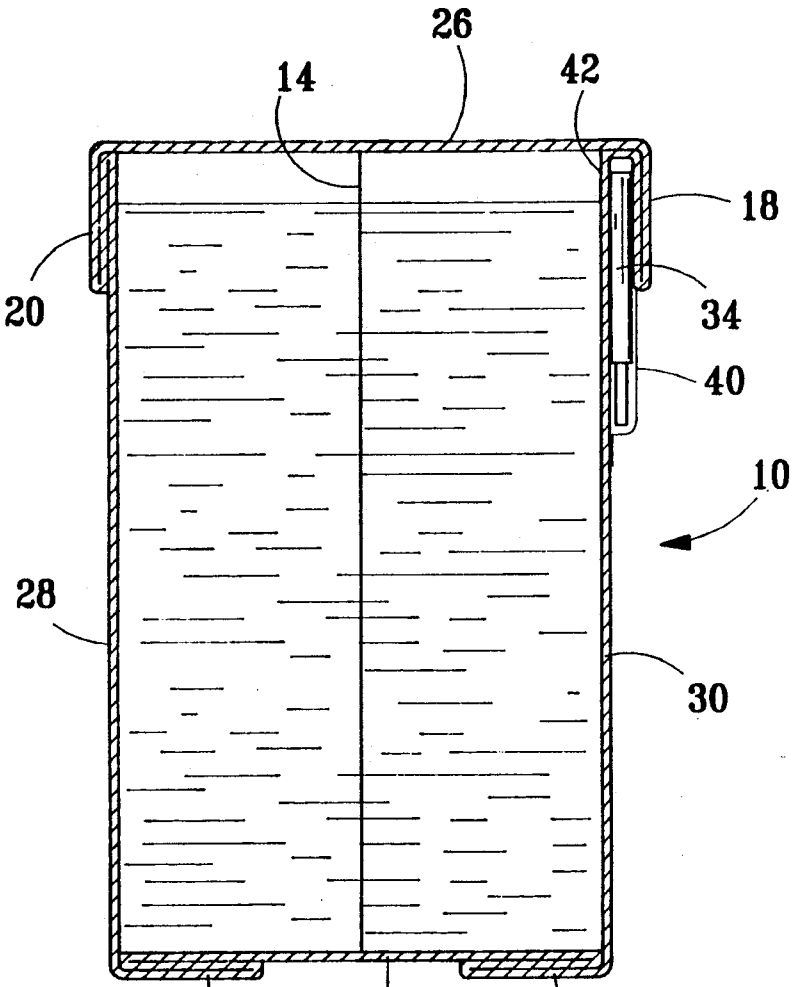
FIG. 3 is a front sectional view of the container with the folded triangle-portion not lifted.

As shown in FIG. 1 and 3, a paper container body (10) is formed by folding a rectangular piece of waterproof paper (12) glued together with an aluminium foil (46) which has a certain thickness. The rectangular piece of paper (12) is folded and water-tightly glued to form a three-dimensional container with six sides in enclosed type.

As shown in FIG. 1 and FIG. 3, the container body (10) consists of a glued edge portion (14), a top side (26), a glued central flange (16) formed on the top side (26) by gluing together along the upper edge of the piece of the paper (12), and four folded triangle-portions (18, 20, 22, 24) near t he four corners of the front edge. Two folded triangle-portions (18, 20) o the top side (26) are extending respectively from the top side (26) horizontally toward opposite side and then are folded downward so as to be glued respectively to the right side (28) and left side (30). The other two folded triangle-portions (22, 24) extending horizontally from sides 28 and 30 are folded back to be glued on the bottom side (32). The central flange (16) is folded sideward to have a parallel contact with the surface of the top side (26) of the container body (10), but it is not glued to the surface of the top side (26).

Figure 4:
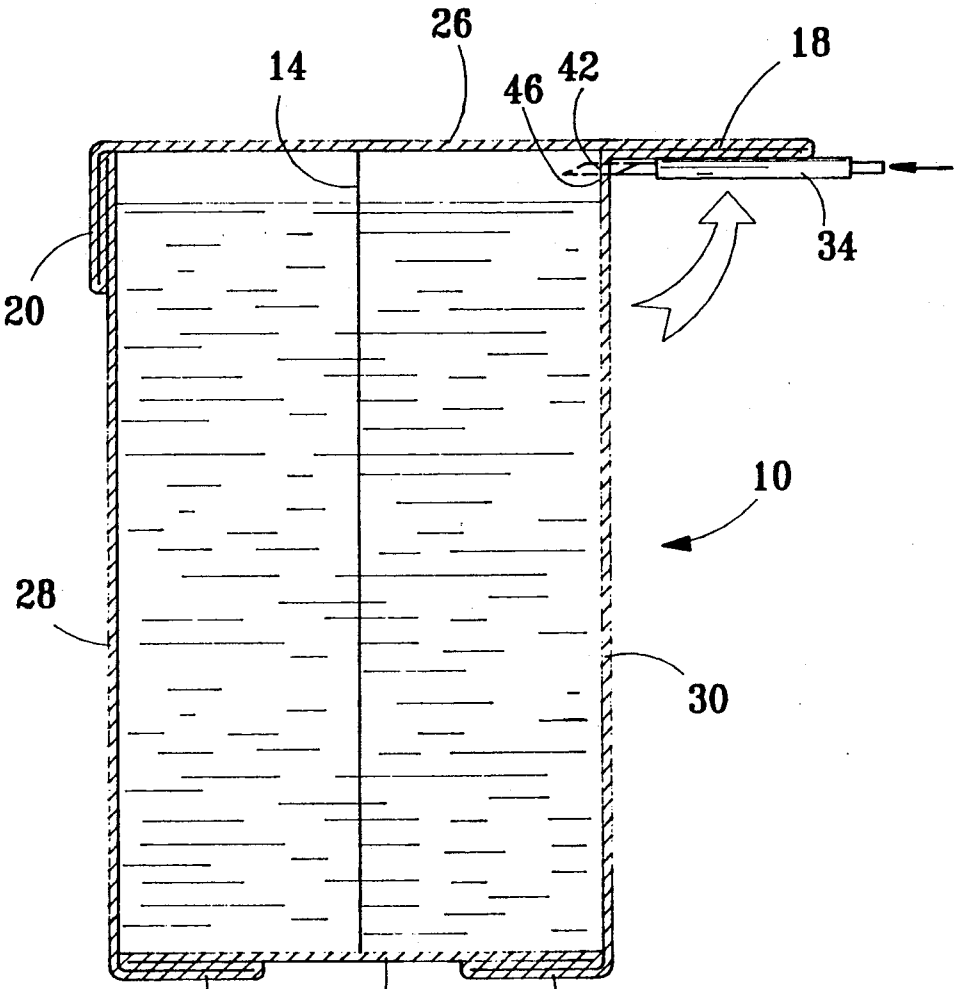
FIG. 4 is a front sectional view of the container with the folded triangle-portion lifted.

As shown in FIG. 4, at least one of the portions of the left side (28) or right side (30) matched with and glued to the folded triangle portion (20) or (18) has a round hole (42) water-tightly sealed by the aluminium sealant patch (46) for the putting in of a sharp sucking pipette (34). The round hold (42) is disposed on the middle of the portion matched with the folded triangle-portion (18). The round hold (42) is hidden and protected by the folded triangular flap portion (18) which is glued to right sides (30) of the container body (10) so as to prevent it from breakage and leakage.

As shown in FIG. 4, the pipette (34) housed in a small bag 40 and glued on the folded triangular flap portion (18). Pipette 34 comprises a tubular support portion and a tubular liquid conduit member so formed with a sharp end which is smaller and longer than the tubular support portion of the pipette (34) itself. When the folded triangular flap portion (18) is lift away from the left or right side and lifted horizontally, the s harp end of the pipette conduit 50 can penetrate the aluminium foil patch (46) sealing t he small round hole (42) so as to suck the drink in the container body (10), see also FIG. 2A, 2B, 2C.

The container body (10) is made of paper (12) and aluminium foil 46 which are soft enough to allow a recess at the center of side (30) for the vertical disposition of the pipette (34) when the disposed pipette (34) is pressed down by other container bodies in a package in process of shipment. Therefore, the pipette (34) which is partly glued between the triangle portion (18) and the surface of the right side (30) will not take much space in a package and may not easily drop off, see also FIG. 3.

Figure 2A:
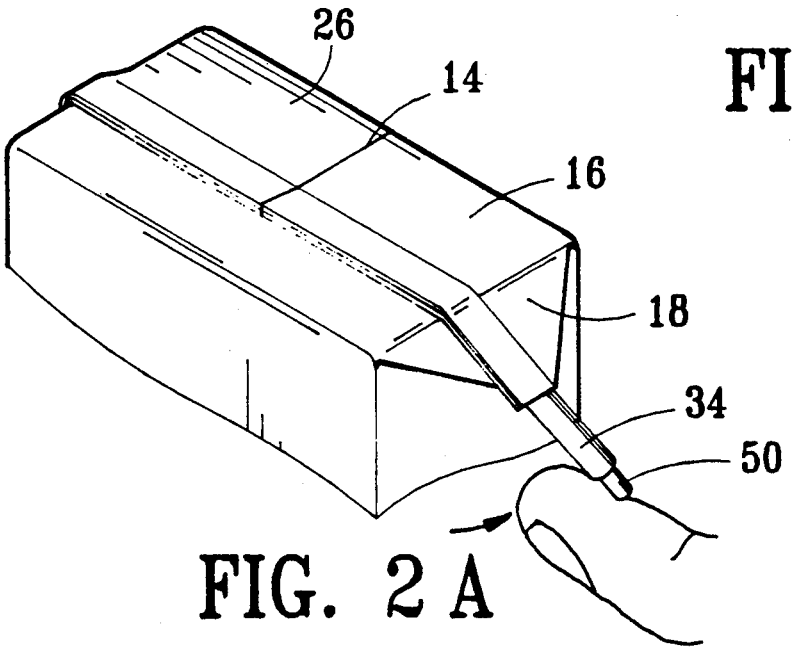
FIG. 2A, FIG. 2B, FIG. 2C are views showing the folded triangle-portion being lifted so as to expose a small round hole and the sucking pipette.
Figure 2B:
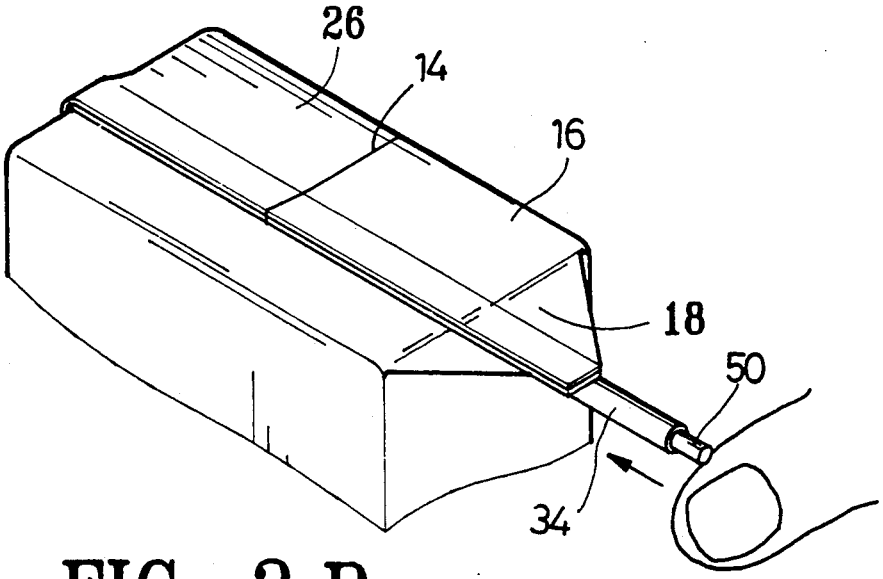
Figure 2C:
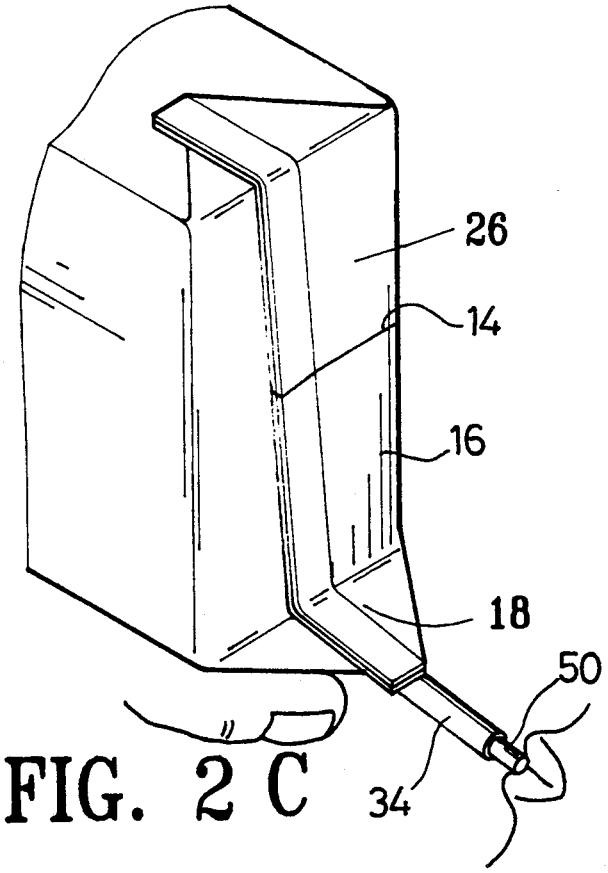

As shown in FIG. 2A, 2B, 2C, the way to use the invention is to tear apart the flap portion (18) with the pipette (34) from the side (30) and lift it up high enough to make it easy for the user to put the sharp end of the conduit portion (50) of the pipette (34) through the round hole (42) into the container body (10).

Figure 5:
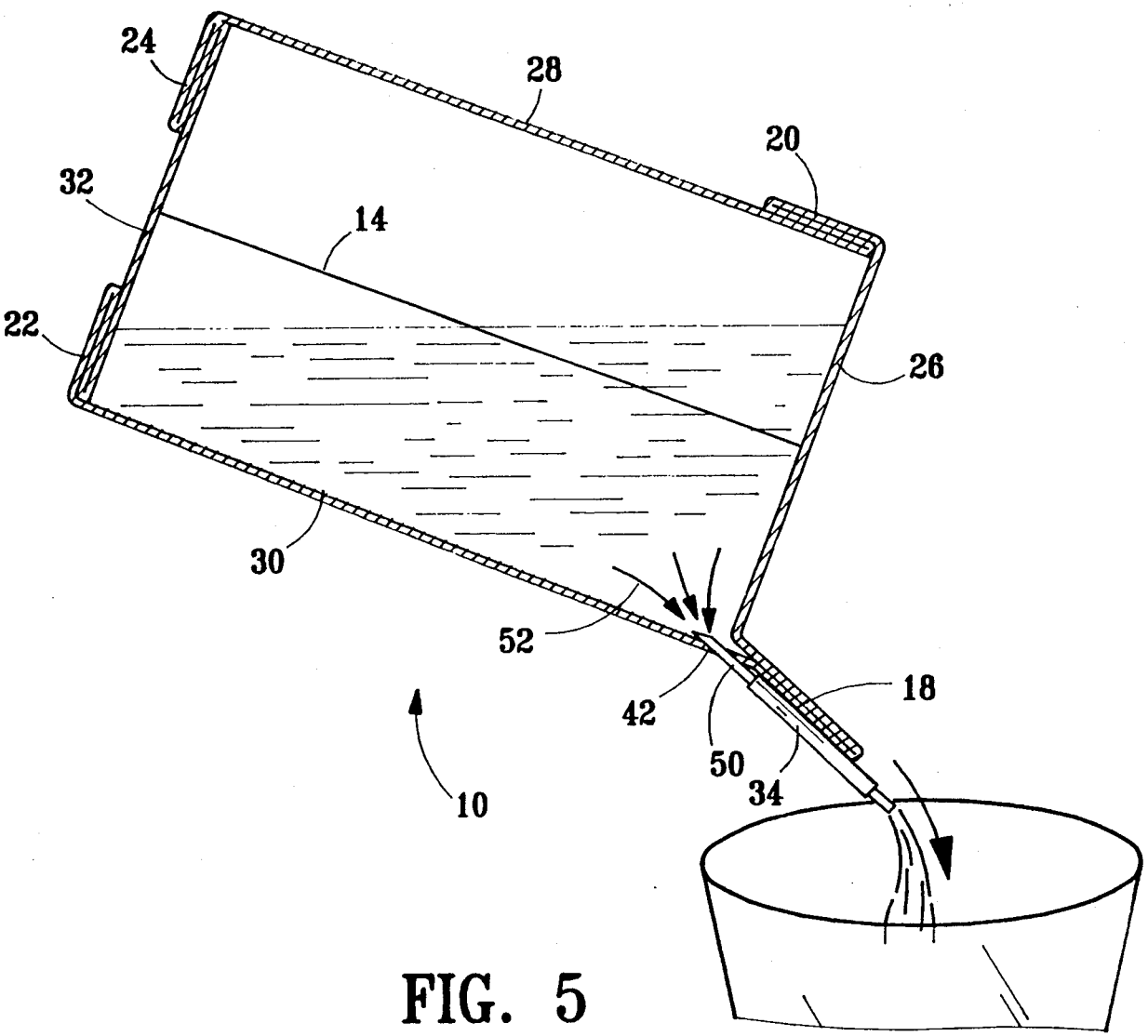
FIG. 5 is a front sectional view of the container in use pouring a drink into a tray.
Figure 6:
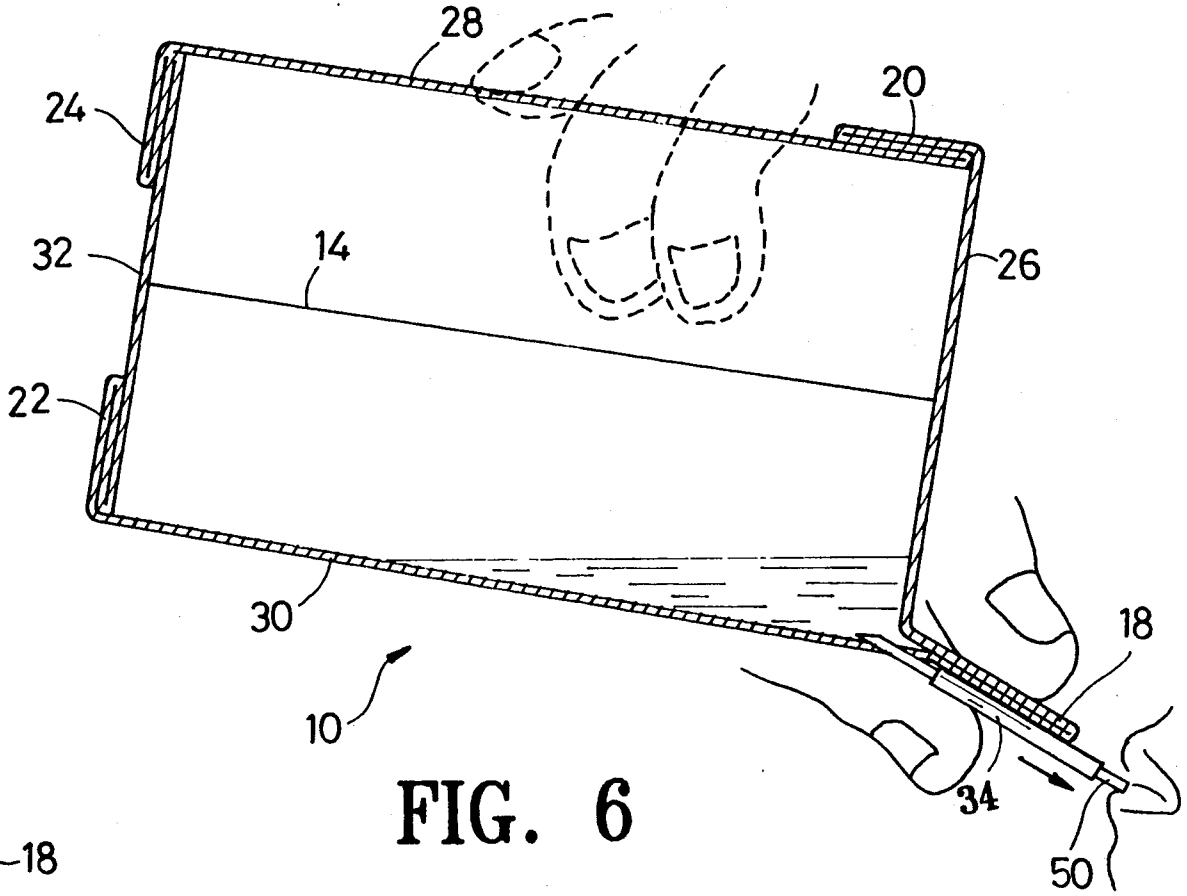
FIG. 6 is a front sectional view of the container in use drinking a drink.
Figure 7:
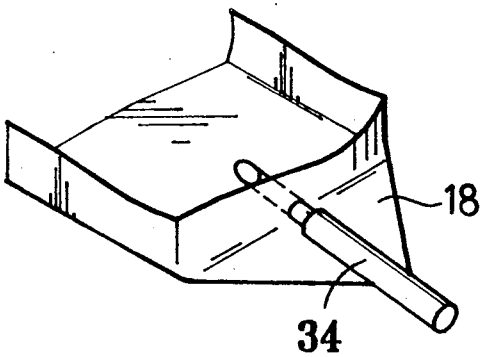
FIG. 7 is a view showing the position of the pipette and the small put-in hole.

As shown in FIG. 5 and 6, when the container body (10) is horizontally held, the round hole 42) will become the lowest portion of the container body (10) so that the drink may easily be sucked out completely, see also FIG. 7.

What is claimed is:

1. A disposable three dimensional drink container having a top wall, a bottom wall, and four side walls, a triangular flap extending from one edge of the top wall for disposition along one of the four side walls; said flap having an inner surface facing said one side wall and an outer surface facing away from said one side wall; a hole in said one side wall near said one edge of the top wall, said hole being in registry with said flap when the flap is disposed along said one side wall; a sealant patch one said one side wall overlying said hole; a hollow extensible pipette means carried on the inner surface of said flap; said pipette means comprising a tubular support means (34) and a hollow tubular liquid conduit means (50) slidably carried in said support means; said hollow tubular conduit means having a sharpened end registrable with said hole when said flap is lifted away from said one side wall to a position in approximate planar alignment with said top wall; said tubular conduit means being manually slidable in said support means so that its sharpened end pierces the sealant patch and extends into said hole.

2. The disposable drink container of claim 1, and further comprising a tearable bag (40) enclosing the pipette means when the flap is disposed along said one side wall.

* * * * *